United States Patent [19]

Ikesue

[11] 4,140,388

[45] Feb. 20, 1979

[54] DRUM CLEANING APPARATUS FOR ELECTROSTATIC COPYING MACHINE

[75] Inventor: Masumi Ikesue, Tokyo, Japan

[73] Assignee: Ricoh Company, Ltd., Tokyo, Japan

[21] Appl. No.: 793,054

[22] Filed: May 2, 1977

[30] Foreign Application Priority Data

May 8, 1976 [JP] Japan ..... 51-52338

[51] Int. Cl.[2] ..... G03G 21/00; B21B 45/02

[52] U.S. Cl. ..... 355/15; 15/256.51; 118/652

[58] Field of Search ..... 355/3 R, 15; 118/652; 15/256.51, 256.52

[56] References Cited

U.S. PATENT DOCUMENTS

| | | | |
|---|---|---|---|
| 3,580,673 | 5/1971 | Yang | 118/652 X |
| 3,859,691 | 1/1975 | Katayama et al. | 15/256.51 |
| 3,917,398 | 11/1975 | Takahashi et al. | 355/15 |
| 3,950,092 | 4/1976 | Zoltner | 118/652 X |

*Primary Examiner*—Fred L. Braun

*Attorney, Agent, or Firm*—David G. Alexander

[57] ABSTRACT

A scraper blade removes residual toner substance from a photoconductive drum subsequent to a copying operation. A resilient guide member which lightly engages with the drum below the scraper blade guides the removed toner substance onto a roller which carries the same to a container. The guide member engages the drum so lightly as not to remove toner substance therefrom. The portion of the guide member engaging with the drum may be resiliently constructed in such a manner as to be moved to a position to catch toner substance falling from between the edge of the scraper blade and the drum when the drum is removed for replacement. The guide member is preferably pivotally mounted so that it is urged into engagement with the photoconductive member by gravity. The guide member is further pivoted by gravity upon removal of the photoconductive member so that a portion of the member is always oriented below the scraper blade to receive falling toner from the blade.

10 Claims, 8 Drawing Figures

DRUM CLEANING APPARATUS FOR ELECTROSTATIC COPYING MACHINE

BACKGROUND OF THE INVENTION

The present invention relates to a drum cleaning apparatus for an electrostatic copying machine.

In an electrostatic copying machine of the dry development type, a photoconductive drum is electrostatically charged and radiated with a light image of an original document to form an electrostatic image thereon through localized photoconduction. A powdered toner substance is applied to the drum to develop the electrostatic image into a toner image which is transferred and fixed to a copy sheet to form a permanent reproduction of the original document.

However, not all of the toner substance is transferred to the copy sheet and residual amount remains. The residual toner substance must be removed prior to another copying operation in order to avoid double printing (the superimposition of an image of the previous document on that of the subsequent document).

An effective way to remove the residual toner substance and thereby clean the drum is by means of a resilient scraper blade made of rubber or the like. In order to preclude contamination of the internal components of the copying machine with the residual toner substance scraped off the drum by the scraper blade it is necessary to catch the toner substance and convey the same to a container, preferably for recycling. It has been proposed in the prior art to provide a roller below the scraper blade. The roller is driven in such a direction as to carry the toner substance which falls thereon from the scraper blade to a container. In order to be effective, the scraper blade must be disposed above the axis of the drum and the roller must be below the axis of the drum. Whereas this type of arrangement is marginally effective, it is inadequate when the amount of toner substance removed by the scraper blade is greater than a certain value. More specifically, although a portion of the removed toner substance is carried to the container by the roller another portion of the removed toner substance spills off the roller onto operating parts of the copying machine.

Two expedients have been attempted in the prior art in order to overcome this problem. As the first, a bias voltage has been applied to the roller which attracts the toner particles and prevents the same from spilling off the roller. However, unless the bias voltage is high enough to cause deterioration of the toner particles and make the same unsuitable for recycling, this first expedient is ineffective.

The second prior art expedient is to make the roller larger in diameter, thereby providing a larger surface area for the toner substance falling from the scraper blade. Whereas this expedient does improve the effectiveness somewhat, it is still inadequate and merely contributes to an overall increase in size of the copying machine.

SUMMARY OF THE INVENTION

In accordance with the present invention, a scraper blade removes residual toner substance from a photoconductive drum subsequent to a copying operation. A resilient guide member which lightly engages with the drum below the scraper blade guides the removed toner substance onto a roller which carries the same to a container. The guide member engages the drum so lightly as not to remove toner substance therefrom. The portion of the guide member engaging the drum may be resiliently constructed in such a manner as to be moved to a position to catch toner substance falling from between the edge of the scraper blade and the drum when the drum is removed for replacement.

It is an object of the present invention to provide a cleaning apparatus for an electrostatic copying machine which effectively removes any amount of residual toner substance from a photoconductive drum after a copying operation and carries the same to a container.

It is another object of the present invention to provide a cleaning apparatus for an electrostatic copying machine which positively prevents residual toner substance removed from a photoconductive drum from contaminating internal components of the copying machine.

It is another object of the present invention to preclude contamination of internal components of an electrostatic copying machine by residual toner substance removed from a photoconductive drum without resort to a high bias voltage which would cause contamination of the toner substance which would preclude recycling of the same or the incorporation of overly large component parts.

It is yet another object of the present invention to prevent contamination of the interior of an electrostatic copying machine by residual toner substance removed from a photoconductive drum after a copying operation when the drum is removed from the copying machine for replacement.

It is another object of the present invention to provide a generally improved cleaning apparatus for an electrostatic copying machine.

Other objects, together with the foregoing, are attained in the embodiments described in the following description and illustrated in the accompanying drawing.

DESCRIPTION OF THE PREFERRED EMBODIMENTS

While the drum cleaning apparatus of the invention is susceptible of numerous physical embodiments, depending upon the environment and requirements of use, substantial numbers of the herein shown and described embodiments have been made, tested and used, and all have performed in an eminently satisfactory manner.

Figure 1:
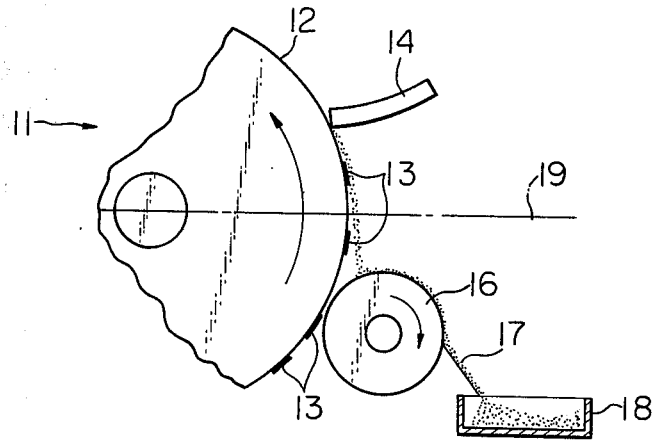
Fig. 1 PRIOR ART
FIG. 1 is a fragmentary schematic view of a prior art cleaning apparatus for an electrostatic copying machine.

Referring now to FIG. 1 of the drawing, a prior art electrostatic copying machine is generally designated by the reference numeral 11 and comprises a photoconductive drum 12 which is driven for counterclockwise rotation at constant speed. Although not shown, a charging unit electrostatically charges the drum 12 which is then radiated with a light image of an original document to form an electrostatic image through localized photoconduction. A developing unit then applies a toner substance in dry particulate form to the drum 12 to develop the electrostatic image into a toner image. A transfer unit transfers the toner image to a copy sheet and a fixing unit thermally or otherwise fixes the toner image to the copy sheet to form a permanent reproduction of the original document.

After the copying operation is completed, a residual amount of toner substance remains on the drum 12 as indicated at 13, which must be removed prior to the next copying operation to prevent double printing.

This function is performed by means of a resilient scraper blade 14 made of rubber or the like which is coextensive in length with the drum 12. The toner substance 13 scraped from the drum 12 by the blade 14 falls onto a roller 16 which is rotated clockwise. A small space or clearance is provided between the roller 16 and the drum 12. The toner substance which falls on the roller 16 is carried thereby to an auxiliary scaper blade 17 which scrapingly engages with the roller 16 to remove the toner substance therefrom and guide the same into a container 18. Preferably, means are provided, although not shown, to recycle the toner substance in the container 18.

Preferably, the roller 16 is made of a material which holds the toner particles thereon by mechanical friction but allows them to be removed by means of the auxiliary scraper blade 17. A suitable material for the roller 16 is polyurethane rubber.

It will be noted that the scraper blade 14 is provided above the axis of the drum 12 which is indicated by a broken line 19. Furthermore, the edge or portion of the scraper blade 14 which engages with the drum 12 is disposed above a portion of the drum 12 which is upstream of the portion of the blade 14 which engages with the drum 12 in the direction of rotation of the drum 12. More specifically, this portion (not designated) of the drum 12 is rightward of a vertical plane perpendicular to the plane of the drawing which passes through the point of engagement of the scraper blade 14 and the drum 12.

It will further be noted that the roller 16 lies below said portion of the drum 12. This is desirable in order for the toner substance removed by the blade 14 to slide down the rightward periphery of the drum 12 onto the roller 16. If the roller 16 were disposed above the axis 19, it whould have to be in engagement with the drum 12 to prevent the removed toner substance from falling into the interior of the copying machine 11 from between the drum 12 and roller 16.

The prior art arrangement generally functions satisfactorily as long as not too much toner substance is removed from the drum 12 by the blade 14. However, if all of the toner substance of a toner image which was not transferred to a copy sheet or on an area of the drum 12 which was not exposed, developed and not transferred were removed by the scraper blade 14, this large amount of toner substance would pile up on the roller 16 and some of it would spill down onto the various internal components of the copying machine 11 through the clearance between the roller 16 and drum 12.

As mentioned hereinabove, it is possible to eliminate the clearance between the roller 16 and drum 12. However, it is extremely difficult to provide uniform pressure between the roller 16 and drum 12 along their entire lengths. In addition, the roller 16 would remove toner substance which would fall downwardly therefrom. Both of these conditions would result in contamination of the various component parts of the copying machine 11 below the roller 16 by the removed toner substance. For these reasons, the prior art arrangement illustrated in FIG. 1 is not satisfactorily effective for its intended purpose.

Figure 2:
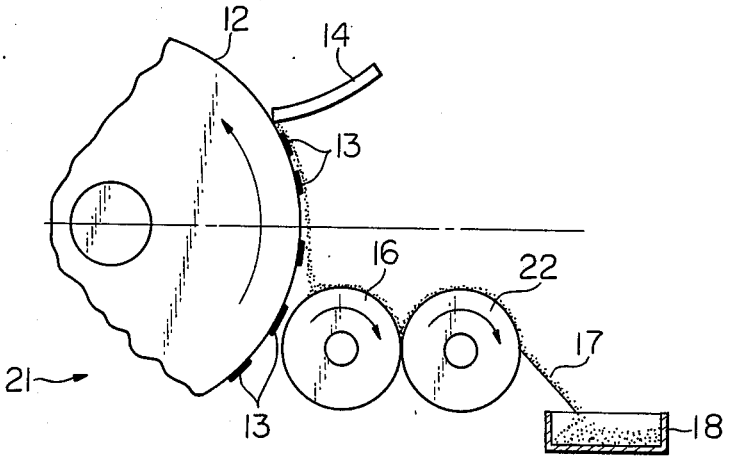
Fig. 2 PRIOR ART
FIG. 2 is similar to FIG. 1 but shows another prior art cleaning apparatus.

FIG. 2 shows a prior art attempt to overcome this problem. Throughout the remainder of this disclosure like elements will be designated by the same reference numerals regardless of whether they are provided in a prior art or present arrangement. In a prior art copying machine 21, the arrangement is generally the same as in the copying machine 11 except that another roller 22 is provided between the roller 16 and container 18.

The roller 22 is rotated clockwise, or in the same direction as the roller 16. However, the roller 22 is made of an electrically conductive material such as stainless steel. The auxiliary scraper blade 17 is advantageously formed of phosphor bronze.

The material of the roller 16 acts as an electric insulator. Frictional engagement between the rollers 16 and 22 causes an electrostatic charge to be developed on the roller 16 which constitutes a bias voltage. This electrostatic charge tends to attract the toner substance to the roller 16.

More specifically, the toner substance falls from the scraper blade 14 onto the roller 16 and is attracted thereto by the electrostatic charge. The toner substance is carried by the roller 16 to the roller 22 which picks up the toner substance therefrom by mechanical friction. The roller 22 dissipates the electrostatic charge of the toner substance through conduction (preferably the roller 22 is grounded) and carries the same to the auxiliary scraper blade 17 which removes the toner substance from the roller 22. The toner substance slides down the auxiliary scraper blade 17 into the container 18.

Although the arrangement of FIG. 2 constitutes some improvement over that of FIG. 1 due to the bias voltage which tends to hold the toner substance on the roller 16, the arrangement of FIG. 2 is still ineffective when the amount of removed toner substance is excessive since some of the toner substance falls down through the clearance between the roller 16 and the drum 12 due to the pile-up of toner substance on the roller 16.

The cause of this undesirable effect can be easily understood by imagining a vertical plane oriented perpendicular to the plane of the drawing and passing through the axis of the roller 16. Due to the arrangement of the drum 12 and roller 16 the toner substance scraped from the drum 12 by the scraper blade 14 falls onto the roller 16 leftwardly of said plane. Thus, if too much toner substance falls on the roller 16 to be held by mechanical friction and/or bias voltage it will spill leftwardly and downwardly through the clearance between the drum 12 and roller 16.

Figure 3:
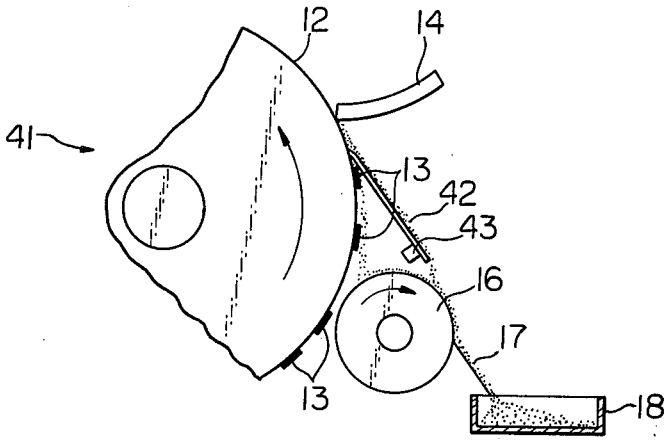
FIG. 3 is a fragmentary schematic view of a first embodiment of a cleaning apparatus for an electrostatic copying machine embodying the present invention.

Illustrated in FIG. 3 is an electrostatic copying machine 41 incorporating a cleaning apparatus of the present invention which, in addition to the component parts of the prior art embodiment of FIG. 1, comprises a guide sheet 42. The guide sheet 42 is preferably thin and somewhat resilient and formed of a polyester film or rubber sheet. The lower edge of the guide sheet 42 is rigidly held by a support 43 and the upper edge of the guide sheet 42 substantially engages with the drum 14. The guide sheet 42 is coextensive in length with the scraper blade 14 and roller 16, with the lower edge of the guide sheet 42 disposed above the roller 16 rightwardly of said plane passing through the axis of the guide roller 16.

The upper edge of the guide sheet 42 substantially engages with the drum 12, with the guide sheet 42 slanting downwardly toward the roller 16. More specifically, the upper edge of the guide sheet 42 may be resiliently deformed so as to lightly engage with the drum 12. In this manner, little or no toner substance will be removed from the drum 12 by the guide sheet 42. Any toner substance which is scrapingly removed from the drum 12 by the guide sheet 42 will fall onto the roller 16 leftwardly of said vertical plane and be carried thereby to the scraper blade 17 and container 18. Alternatively, a small clearance may be provided between the upper edge of the guide sheet 42 and the drum 12.

Toner substance scrapingly removed from the drum 12 by the scraper blade 14 slides down the rightward periphery of the drum 12 onto the guide sheet 42. The toner substance slides down the guide sheet 42 onto the roller 16 which carries the same to the container 18.

In accordance with an important feature of the invention the removed toner substance falls from the scraper blade 14 onto the guide sheet 42 and slides down the guide sheet 42 onto the roller 16 downstream of the uppermost portion of the roller 16 in the direction of rotation thereof. This feature makes the present invention effective regardless of the amount of toner substance removed. More specifically, if too much toner substance is removed to be held on the roller 16 by mechanical friction, the excess toner substance will slide down the roller 16 rightwardly onto the auxiliary scraper blade 17 rather than leftwardly to fall through the clearance between the roller 16 and drum 12.

In accordance with another important feature of the invention the upper edge of the guide sheet 42 engages with the drum 12 in such a manner as to constitute a seal preventing removed toner substance from falling between the drum 12 and guide sheet 42. Thus, substantially all toner substance removed from the drum 12 by the scraper blade 14 slides down the guide sheet 42 to the roller 16. However, the upper edge of the guide sheet 42 engages with the drum 12 so lightly (or not at all in case a small clearance is provided) that little or no toner substance is removed from the drum 12 by the guide sheet 42. In other words, the guide sheet 42 acts as a one-way valve for the toner substance on the drum 12.

Figure 4:
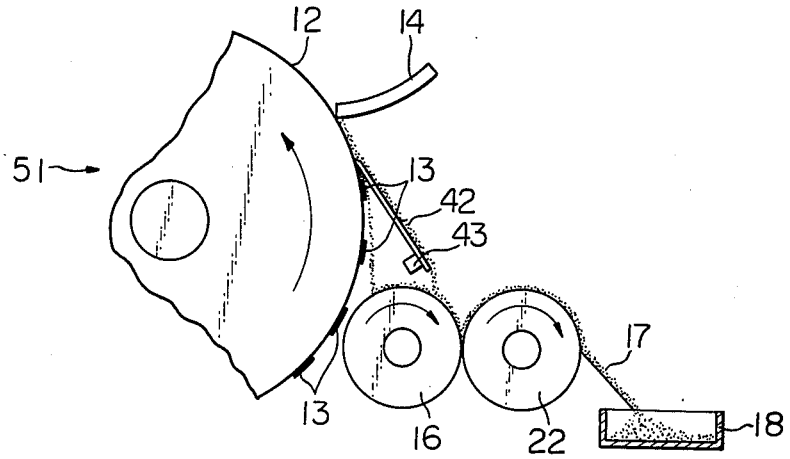
FIG. 4 shows a second embodiment of the invention.

FIG. 4 shows another copying machine 51 embodying the present invention in which the guide sheet 42 is incorporated into the prior art embodiment of FIG. 2. The copying machine 51 functions in the same manner as the copying machine 41 except for the additional provision of the roller 22, and it is believed that any further description would constitute mere repetition.

In the embodiments of FIGS. 3 and 4 the scraper blade 14 may be removed for replacement or cleaning without any toner substance accumulated in the area of engagement between the scraper blade 14 and the drum 12 falling into the interior of the copying machine, since such toner substance would be caught by the guide sheet 42. However, if the drum 12 were removed for replacement, such toner substance would fall into the interior of the copying machine since the portion of engagement of the scraper blade 14 and the drum 12 lies leftwardly of the portion of engagement of the guide sheet 42 and the drum 12. The embodiments of FIGS. 5 and 6 are specifically adapted to prevent this undesirable effect and are most preferably utilized in copying machines in which the drum 12 must be replaced periodically.

Figure 5:
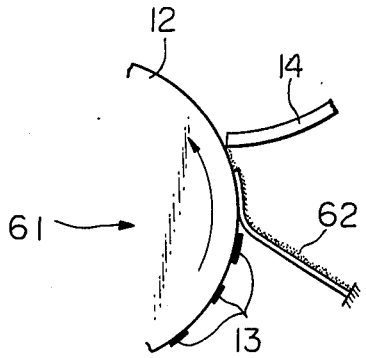
FIG. 5 shows a third embodiment of the invention.
Figure 6:
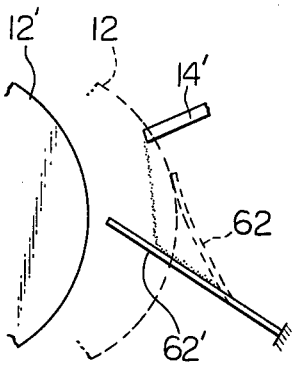
FIG. 6 is a diagram illustrating the operation of the embodiment of FIG. 5.

In FIG. 5, an electrostatic copying machine 61 of the present invention comprises a modified guide sheet 62 which performs the same function as the guide sheet 42. However, the upper edge portion of the guide sheet 62 is made longer than that of the guide sheet 42 and is resiliently deformed upwardly along the periphery of the drum 12 through engagement therewith. The advantage of this arrangement is shown in FIG. 6 in which the elements shown in broken line correspond to the illustration of FIG. 5. Shown in solid line are the same elements where the drum 12 has been removed from the copying machine 61 to such an extent that the drum 12 disengages from the guide sheet 62, with the elements in solid line designated by the same reference numerals primed. As is clearly shown, the scraper blade 14' and guide sheet 62' resiliently restore to their unstressed forms with the upper edge portion of the guide sheet 62' disposed below and leftwardly of the left edge of the scraper blade 14'. Due to this arrangement, any toner substance falling from the left edge of the scraper blade 14' upon disengagement of the drum 12' therefrom falls onto the guide sheet 62'. Due to the angle of the guide sheet 62', the same will be again resiliently deformed to the position of 62 when a new drum 12 is mounted into the copying machine 61.

Figure 7:
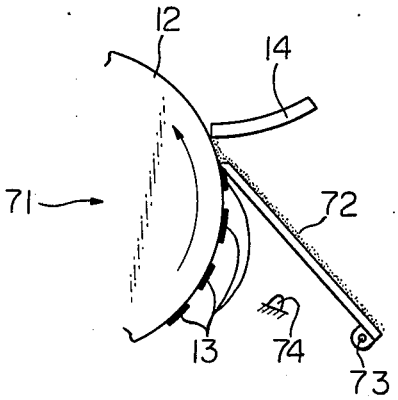
FIG. 7 shows a fourth embodiment of the invention.

FIG. 7 shows another copying machine 71 embodying the present invention which replaces the guide sheet 62 with a guide plate 72. The lower edge of the guide plate 72 is pivotal about a fulcrum 73 and the upper edge thereof lightly engages with the drum 12. The guide plate 72 is pivoted counterclockwise by gravity into engagement with the drum 12 and is formed of a substantially rigid material. However, the material of the guide plate 72 is selected to minimize mechanical friction between the upper edge of the guide plate 72 and the drum 12. The guide plate 72 serves the same function as the guide sheet 42 by guiding toner substance removed from the drum 12 by the scraper blade 14 to the roller 16.

Figure 8:
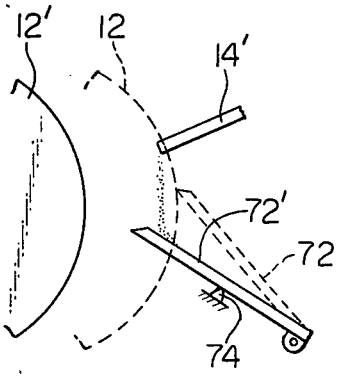
FIG. 8 is a diagram illustrating the operation of the embodiment of FIG. 7.

Upon removal of the drum 12, the component parts of the copying machine 71 move to the positions shown in solid line in FIG. 8 in which these elements are designated by the same reference numerals primed.

Removal of the drum to the position of 12' allows the guide plate 72 to pivot further counterclockwise into abutment with a stop member 74. In the solid line position of FIG. 8, the left edge of the guide plate 72' is positioned below and leftwardly of the left edge of the scraper blade 14' so that any toner substance falling from the left edge of the scraper blade 14' falls onto the guide plate 72'. When a new drum 12 is mounted in the copying machine 71, the guide plate 72 is pivoted clockwise thereby into the position of FIG. 7.

In summary, it will be seen that the present invention overcomes the problem of contamination of the interior of an electrostatic copying machine by residual toner substance removed from a photoconductive drum by a resilient scraper blade without resort to unadvantageously high bias voltages or large component parts of the drum cleaning apparatus.

Many modifications will become possible for those skilled in the art after receiving the teachings of the present disclosure without departing from the scope thereof. For example, although the present invention has been herein shown and described as being incorporated into an electrostatic copying machine employing the dry development process, it may be adapted to a copying machine utilizing a wet or semi-moist development process. Although a means for receiving removed toner substance from the present guide member (sheet or plate) is shown and described as comprising a roller, it is clear that the present invention may be adapted so that the guide member guides the removed toner substance directly into a container.

What is claimed is:

1. In an electrostatic copying machine having a rotary photoconductive member, a cleaning apparatus comprising:

a scraper blade engaging with the photoconductive member to scrapingly remove residual toner substance therefrom;

receiving means for receiving the toner substance; and a guide member in substantial light engagement with the photoconductive member configured such that the toner substance drops from the scraper blade onto the guide member and slides down the guide member to the receiving means, the guide member being pivotally supported in such a manner as to be urged into engagement with the photoconductive member by gravity, the guide member being further pivoted by gravity upon removal of the photoconductive member so that a portion of the guide member is oriented below a portion of the scraper blade which engages the photoconductive member and said portion of the guide member receives toner substance falling from between the scraper blade and the photoconductive member.

2. A cleaning apparatus as in claim 1, in which the photoconductive member comprises a drum.

3. A cleaning apparatus as in claim 1, in which the guide member is formed of a rigid material.

4. A cleaning apparatus as in claim 1, further comprising a stop member to limit pivotal movement of the guide member upon removal of the photoconductive member.

5. A cleaning apparatus as in claim 1, in which the receiving means comprises a roller and a container, the roller being rotated in a direction such that toner substance falling thereon from the guide member is carried by the roller and falls therefrom into the container.

6. A cleaning apparatus as in claim 5, further comprising an auxiliary scraper blade for removing the toner substance from the roller and guiding the toner substance into the container.

7. A cleaning apparatus as in claim 5, in which the toner substance falls from the guide member onto a portion of the roller downstream of an uppermost portion of the roller in the direction of rotation thereof.

8. A cleaning apparatus as in claim 1, in which the receiving means comprises a first roller, a second roller and a container, the first roller being rotated in a direction such that toner substance falling thereon from the guide member is carried by the first roller to the second roller, the second roller engaging with the first roller to remove the toner substance therefrom and being rotated in a direction to carry the toner substance to the container.

9. A cleaning apparatus as in claim 8, further comprising an auxiliary scraper blade for removing the residual toner substance from the second roller and guiding the toner substance into the container.

10. A cleaning apparatus as in claim 8, in which the first roller is formed of an electrically insulative material and the second roller is formed of an electrically conductive material.

* * * * *